United States Patent [19]

Itameri-Kinter et al.

[11] Patent Number: 4,964,788

[45] Date of Patent: Oct. 23, 1990

[54] HERMETIC TERMINAL WITH TERMINAL PIN ASSEMBLIES HAVING FUSIBLE LINKS AND MOTOR COMPRESSOR UNIT INCLUDING SAME

[75] Inventors: Terry Itameri-Kinter, North Attleboro; David W. Sauerbrey, Somerset, both of Mass.; Victor Troia, North Providence, R.I.

[73] Assignee: Tecumseh Products Company, Tecumseh, Mich.

[21] Appl. No.: 497,086

[22] Filed: Mar. 21, 1990

[51] Int. Cl.[5] ..... F04B 35/04; H01R 13/68; H01B 17/30

[52] U.S. Cl. ..... 417/422; 174/152 GM; 337/1; 417/902; 439/621; 439/926

[58] Field of Search ..... 174/152 GM; 310/71; 361/22, 24, 25; 417/422, 902; 439/566, 621, 622, 685, 693, 926, 935

[56] References Cited

U.S. PATENT DOCUMENTS

| | | | |
|---|---|---|---|
| 3,007,130 | 10/1961 | Martin | 174/152 GM X |
| 3,988,053 | 10/1976 | Dodenhoff | 174/152 GM X |
| 4,252,394 | 2/1981 | Miller | 174/152 GM X |
| 4,480,151 | 10/1984 | Dozier | 174/153 R |
| 4,584,433 | 4/1986 | Bowsky et al. | 174/152 GM |
| 4,609,774 | 9/1986 | LeMieux et al. | 174/152 GM |
| 4,739,551 | 4/1988 | Bowsky et al. | 174/152 GM X |
| 4,786,762 | 11/1988 | Bowsky et al. | 174/152 GM |
| 4,830,630 | 5/1989 | Dozier | 439/622 |

*Primary Examiner*—Laramie E. Askin

*Attorney, Agent, or Firm*—Jeffers, Hoffman & Niewyk

[57] ABSTRACT

A hermetic terminal for carrying electric current into the housing of a hermetic compressor, including a metallic body member formed with three collar portions that define apertures through which respective fusible terminal pin assemblies extend. Each terminal pin assembly includes two electrically conducting pin segments interconnected by an electrically insulating sleeve member having opposite open ends into which respective ends of each pin segment are telescopingly received. The sleeve member and pin segments define a closed cavity in which a cylindrical fusible link is disposed. Opposite ends of the fusible link are received within respective counterbores in axial ends of the pin segments within the closed cavity, and are retained therein by a brazed joint. Each pin assembly is sealingly retained within a respective collar portion of the terminal body by a glass seal, which contacts the insulating sleeve and optionally surrounds one of the joints between the insulating sleeve and the pin segments.

20 Claims, 3 Drawing Sheets

HERMETIC TERMINAL WITH TERMINAL PIN ASSEMBLIES HAVING FUSIBLE LINKS AND MOTOR COMPRESSOR UNIT INCLUDING SAME

BACKGROUND OF THE INVENTION

The present invention relates generally to hermetic compressors of the type having a hermetic housing, wherein a hermetic terminal is provided for carrying electric current into the housing and, more particularly, to such a terminal that will maintain the integrity of its hermetic seal even under overcurrent conditions.

Typically, a hermetic terminal is installed in a hole formed in the housing of a hermetic compressor so that current may be carried to the compressor motor from an external source of power. The terminal comprises a body member welded or otherwise secured to the compressor outer housing and a plurality of conductor pins extending through the body member. In order to seal and electrically insulate the conductor pins relative to the body member, a glass-to-metal seal is employed, having an epoxy and/or silicone rubber overcoating. Both the inner and outer ends of the conductive pins may be provided with conductor tabs so as to facilitate connection to the external current source and to the compressor motor.

A problem associated with prior art hermetic terminals is that, in response to unexpected abnormally high overcurrent conditions, e.g., due to a ground fault or a short circuit, the conductor pins may heat up to the point of melting the conductor pins themselves or the surrounding glass-to-metal seals, thereby resulting in failure of the hermetic terminal.

One method for preventing occurrence of the aforementioned failure mode of a hermetic terminal is to use a fusible link within the conductive path of each conductor pin. In general, the fusible link portion has a smaller cross-sectional area than the remaining portions of the conductor pin, and is designed to fuse first upon the occurrence of an overcurrent condition. When an overcurrent condition begins to occur, the fusible link will fuse and terminate the supply of electric current to the compressor motor before the conductor and/or glass-to-metal seal are destroyed by excessive temperatures.

In one prior art hermetic terminal, a pin assembly includes a fusible link attached to and disposed intermediate two pin parts. Specifically, opposite axial ends of the fusible link are received in respective axial bores in the ends of the pin parts. The ends are then crimped to create electrical contact between the pin parts and the fusible link. It is generally recognized that a crimped attachment provides a high resistance and unreliable electrical connection.

In addition to problems of insufficient electrical contact between the fusible link and the pin parts, some terminal assemblies do not provide a reservoir into which a melted or vaporized fusible link may migrate in the event of an overcurrent condition. Such assemblies risk the possibility of incomplete electrical separation between the pin parts and the fusible link.

In U.S. Pat. No. 4,830,630, a hermetic terminal includes pin assemblies each having a fuse link surrounded by a multipiece protective capsule defining an expansion cavity. In order to exhaust the built-up pressure in the capsule and, at the same time, maintain the integrity of the seal between the conductor pin assemblies and body member of the hermetic terminal, the protective capsule is designed to rupture upon rapid vaporization of the fuse material within the expansion cavity. In such an assembly, an outer sealing member fractures upon rupture of the protective capsule, thereby causing the pin parts to separate from the remainder of the terminal. A disadvantage of this hermetic terminal design is the existence of many component parts, including the requirement of a fracturing sealing member surrounding the protective capsule on an extended inner or outer side of the terminal body.

SUMMARY OF THE INVENTION

The present invention provides a hermetic terminal including fusible terminal pin assemblies extending through apertures in the terminal body, wherein each terminal pin assembly includes an electrically insulating intermediate portion in which is disposed a fusible link that interconnects electrically conducting ends of the pin assembly. The intermediate portion of each pin assembly is at least partially disposed within a respective collar portion of the terminal body defining the respective apertures therein. A seal is disposed intermediate each pin assembly and a corresponding collar portion of the terminal body.

Generally, the invention provides in one form thereof a hermetic terminal for a hermetic compressor in which two pin segments of a terminal pin assembly are linked together by a fusible material. The fusible material and adjacent ends of each segment of the terminal pin assembly are telescopingly received within an electrically insulating protective sleeve. The sleeve is disposed at least partially within the collar portion of the hermetic terminal, and provides a cavity for molten fusible material to migrate, thereby ensuring complete electrical disconnection of the pin segments. In one form of the invention, opposite ends of the fusible link are received within respective counterbores in the axial ends of the pin segments and are secured thereto by a brazing material disposed between the fusible link and the counterbore.

One advantage of the hermetic terminal of the present invention is the provision of fusible terminal pin assemblies of a relatively simple design utilizing a minimum number of component parts.

Another advantage of the hermetic terminal according to the present invention is that a more reliable and better performing connection is provided between pin segments and the fusible link in a conducting pin assembly of the hermetic terminal, whereby the connection results in lower pin segment temperatures when an electrical current is passed therethrough.

A further advantage of the hermetic terminal of the present invention is that an expansion cavity is provided for the fusible link without requiring a molded sealing member surrounding the structure defining the expansion cavity.

Still another advantage of the hermetic terminal of the present invention, in one form thereof, is that one pin-to-sleeve joint of each conducting pin assembly is exposed externally of the hermetic terminal and the other pin-to-sleeve joint is sealed within the sealing material closing the respective terminal body aperture, whereby the exposed joint is not subject to compression glass-to-metal seal constraint and, therefore, can be designed to fail upon occurrence of an overcurrent condition, thereby providing an indication of a melted fuse link while maintaining the hermetic seal of the compressor housing.

The invention, in one form thereof, provides a hermetic compressor including a housing having an opening therein. An electric motor is operatively disposed within the housing. The compressor also includes a hermetic terminal for carrying electric current from an external source of power to the motor within the housing. The hermetic terminal comprises a metallic body member closing the housing opening, and a plurality of collar portions defining pin openings in the body member. A plurality of current-conducting pin assemblies are disposed in the pin openings and pass through the body member. Each pin assembly includes an inner pin segment disposed at least partially inside the housing, an electrically insulating intermediate pin segment, and an outer pin segment disposed at least partially outside the housing, wherein the intermediate segment interconnects the inner and outer segments. According to one aspect of this form of the invention, the intermediate pin segment is a sleeve disposed at least partially within the collar portion, wherein the inner and outer pin segments are telescopingly received within opposite ends of the sleeve. The intermediate pin segment defines a closed cavity with the inner and outer pin segments, and a fusible link is provided within the closed cavity for fusibly and electrically interconnecting the inner pin segment and the outer pin segment. A glass seal is disposed intermediate each pin assembly and its corresponding collar portion to seal each of the openings in the body member.

The invention further provides, in one form thereof, a compressor having a hermetic terminal comprising a body member and a current conducting pin assembly passing through the body member. The pin assembly comprises a first pin segment, a second pin segment and an electrically insulating sleeve interconnecting the first pin segment and the second pin segment. The sleeve defines a closed cavity with the first and second pin segments. A fusible link having opposite ends is disposed within the cavity. The first and second pin segments are connected to opposite ends of the fusible link by first and second brazed joints, respectively.

It is an object of the present invention to provide a compact hermetic terminal for a compressor, including reliable fusible terminal pin assemblies having relatively few component parts.

It is another object of the present invention to provide a pin assembly for a hermetic terminal, including a fusible link having a very reliable pin-to-fuse link joint.

It is a further object of the present invention to provide an expansion cavity for the fusible link of a hermetic terminal that does not require a sealing member covering its outer portion.

Another object of the present invention is to provide a hermetic terminal assembly having a fusible link that cuts off the flow of current but does not necessitate rupture of other terminal components in the event of an overcurrent condition.

Still another object of the present invention, in one form thereof, is to provide a hermetic terminal in which melting of the fusible link is readily detected upon sight.

DESCRIPTION OF THE PREFERRED EMBODIMENT

Figure 1:
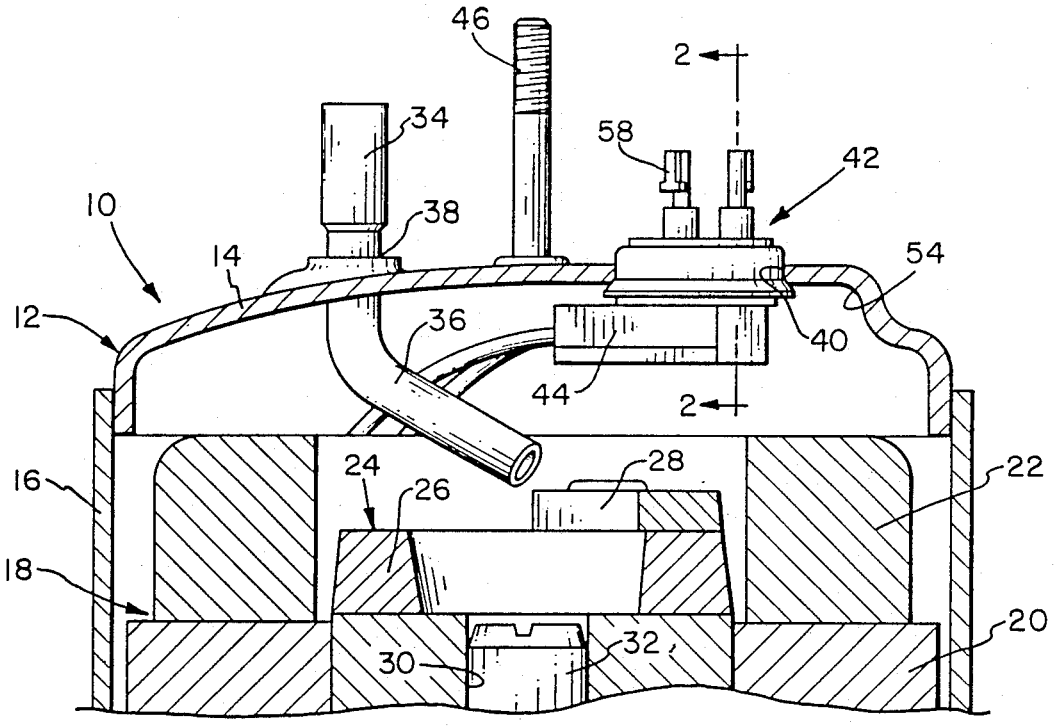
FIG. 1 is a fragmentary partial sectional view of a hermetic compressor, including a hermetic terminal in accordance with the present invention.

In an exemplary embodiment of the invention as shown in the drawings, and in particular by referring to FIG. 1, a hermetic compressor 10 is shown having a housing generally designated at 12. Housing 12 comprises a top portion 14, a central portion 16, and a lower portion (not shown). The three housing portions are hermetically sealed together as by welding or brazing. Disposed within housing 12 is an electric motor generally designated at 18. Motor 18 comprises a stator 20 having windings 22, and a rotor 24 having an end cap 26 to which a counterweight 28 is attached. The stator is secured to housing 12 by an interference fit such as by shrink fitting.

Rotor 24 has a central aperture 30 provided therein into which is secured a rotatable crankshaft 32 by an interference fit. Crankshaft 32 is drivingly connected to a compressor mechanism (not shown), e.g., a reciprocating compressor or rotary vane compressor, which compresses refrigerant for discharge into the interior of housing 12. A refrigerant discharge tube 34 extends through top portion 14 of the housing and has an end 36 thereof extending into the interior of the compressor housing as shown. The tube is sealingly connected to housing 12 at 38, as by soldering.

Top portion 14 includes an opening 40 in which is provided a hermetic terminal assembly 42 for carrying electrical current from outside of housing 12 to motor 18 when compressor 10 is operably connected to an external power source (not shown). An electric plug and wiring assembly 44 connects to terminal assembly 42 on the interior of the housing and carries current to stator windings 22. Compressor 10 also includes a post 46 welded to top portion 14 for mounting a terminal cover (not shown) to cover terminal assembly 42 once compressor 10 is operably installed.

Figure 2:
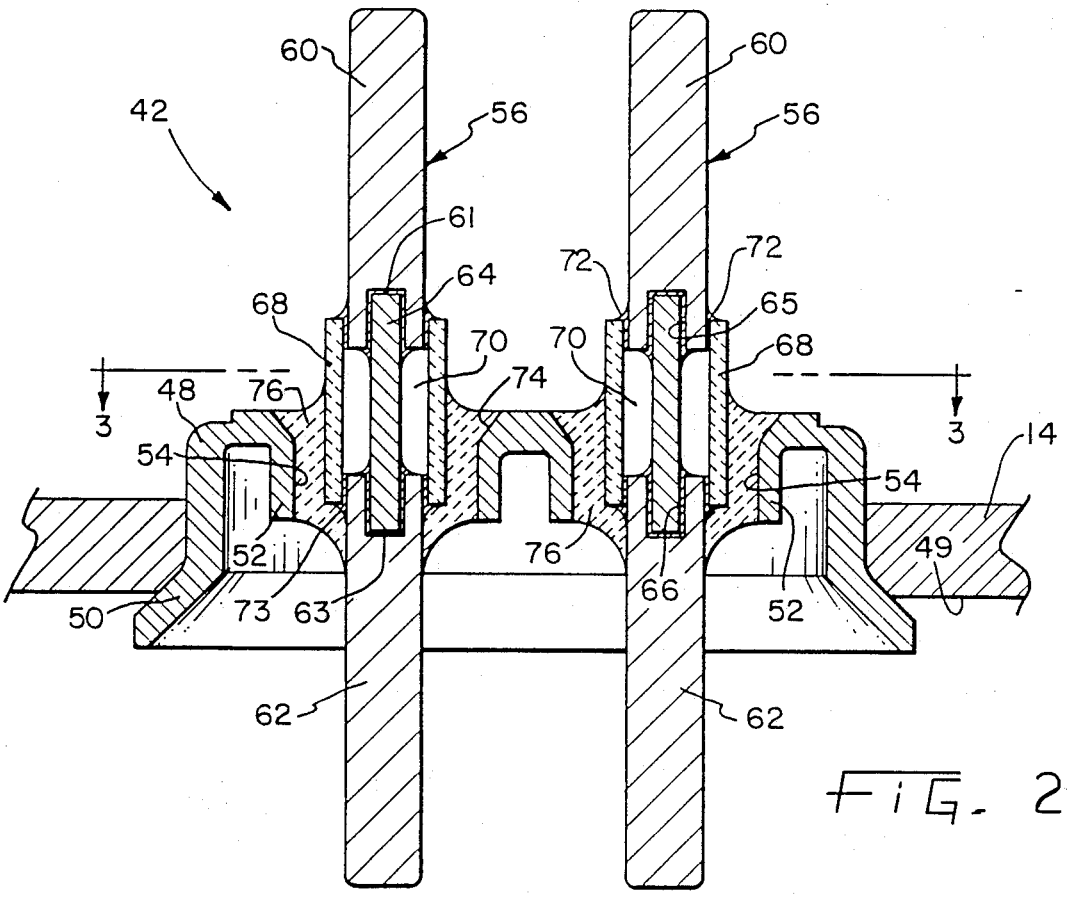
FIG. 2 is an enlarged longitudinal sectional view of the hermetic terminal of FIG. 1, taken along the line 2—2 in FIG. 1.
Figure 3:
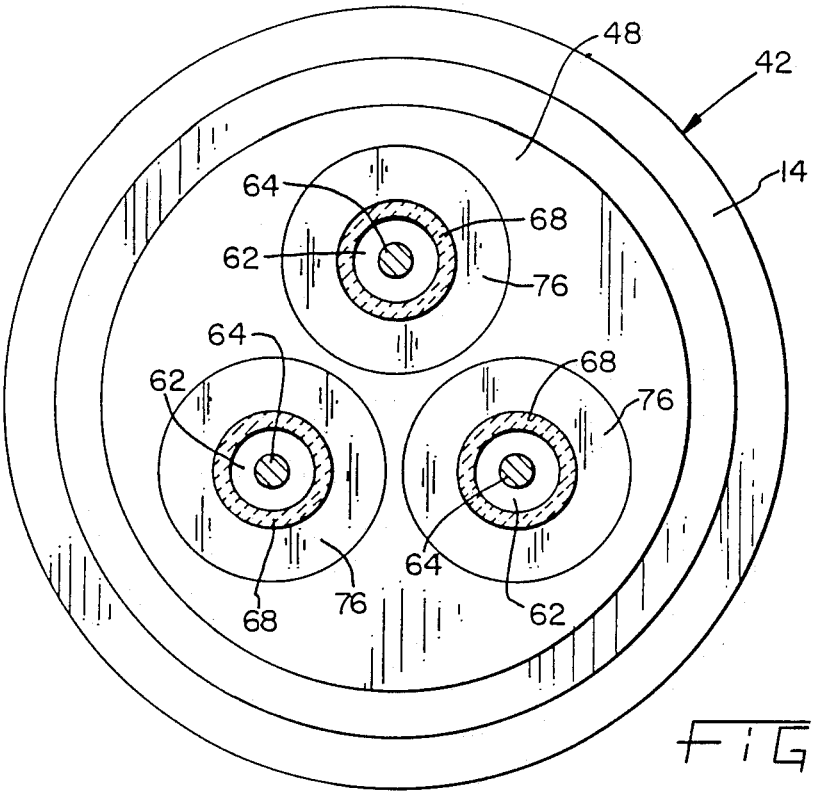
FIG. 3 is a transverse sectional view of the hermetic terminal of FIG. 1, taken along the line 3—3 in FIG. 2.

Referring now to FIGS. 2 and 3, terminal assembly 42 comprises a metallic, cup-shaped body member 48 having a flange 50 and three inwardly extending collars 52 defining respective openings 54 extending through body member 48. Flange 50 is disposed against the inner surface 49 of cover 14 of housing 12 when terminal assembly 42 is welded into place, thereby ensuring that the body member 48 will not be dislodged by the high pressure within housing 12.

A metallic conductor pin assembly 56 is received and retained in each of the openings 54. Each conducting pin assembly 56 comprises a first pin segment 60 extending externally of housing 12, a second pin segment 62 disposed substantially within housing 12, and a fusible link 64 having opposite ends 61 and 63 connected to first and second segments 60 and 62, respectively. Specifically, end 61 is received within a counterbore 65 in pin segment 60 and is brazed therein using a brazing filler metal, e.g., a silver-based alloy. Likewise, end 63 is received and brazed within a counterbore 66 in pin segment 62. Alternatively, the ends of fusible link 64 may abut with and be brazed to first and second segments 60 and 62 without counterbores. It is contemplated that the connections between fusible link 64 and first and second segments 60 and 62 may also be made by welding, e.g., laser welding.

It will be appreciated that the aforementioned brazed or welded connections between the pin segments and the fusible link are much more electrically reliable than traditional crimped connections. In one embodiment of the invention, pin segments 60 and 62 are 446 stainless steel or some other suitable electrically conducting materials, such as copper-cored 446 stainless steel. Also, pin assemblies 56 are optionally provided with tabs 58 secured to their external ends to facilitate the attachment of connecting leads (not shown).

In a preferred embodiment, fusible link 64 is cylindrical in shape, having a diameter of approximately 0.040 inch, and is composed of a phosphor bronze material having a melting temperature in the range of approximately 1750 to 1970 degrees Fahrenheit. However, it is noted that fusible link 64 may be composed of other materials and/or assume other configurations and sizes in order to achieve the desired overcurrent limit or temperature, or to facilitate welding or brazing thereof.

An insulating sleeve 68, preferably made of an electrically insulating ceramic material, e.g., alumina, is axially interposed between pin segments 60 and 62 and coaxially surrounds fusible link 64 to form an expansion cavity 70 circumjacent fusible link 64. As illustrated in FIGS. 2 and 3, pin segments 60 and 62 are each telescopingly received into opposite open ends of sleeve 68. In a preferred embodiment, pin segments 60 and 62 are sealingly retained within the open ends of sleeve 68 at brazed or glass-to-metal seal joints 72 and 73, respectively. A brazed joint requires that the connecting portion of the ceramic sleeve first be metalized.

In order to electrically insulate each pin assembly 56 from body member 48 and to seal the annular space between each pin assembly and the inner surfaces 74 of a respective collar 52, the annular space is filled with a glass seal 76, which is compression fused therein. In the preferred embodiment of FIGS. 2 and 3, seal 76 contacts sleeve 68 and surrounds the junction between pin segment 62 and sleeve 68, thereby providing a compression glass-to-metal seal constraint thereabout. In contrast, the junction between pin segment 60 and sleeve 68 remains exposed on the exterior of the compressor housing and is not subject to a compression glass-to-metal seal constraint.

The fact that a compression glass-to-metal seal constraint is not provided at the junction between pin segment 60 and sleeve 68 in the embodiment of FIGS. 2 and 3 can be used to optionally design a pin assembly in which an intentional separation of that junction occurs, thereby providing a visual indication that an overcurrent condition has occurred. Specifically, when an overcurrent condition occurs and fuse link 64 melts or vaporizes, an increased pressure is developed in expansion cavity 70. The unconstrained junction between pin segment 60 and sleeve 68 can be designed to respond to the increased pressure by cracking or separating to provide a visual indication.

Figure 4:
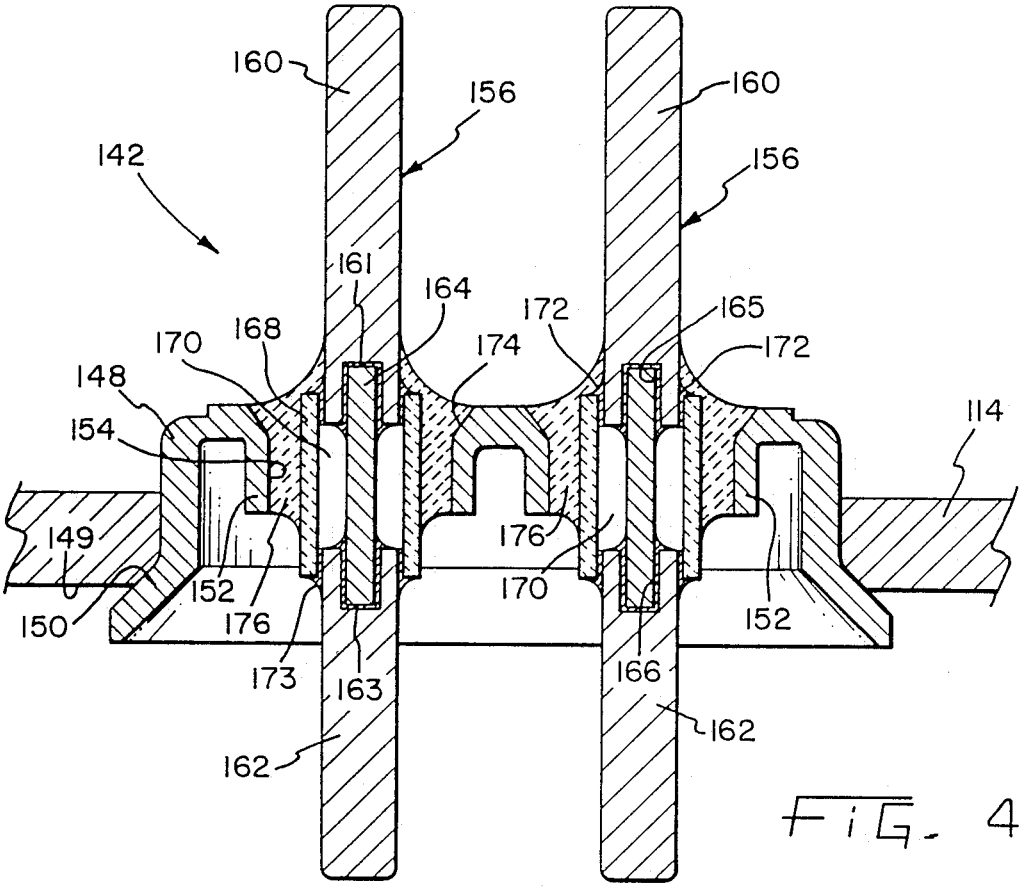
FIG. 4 is an enlarged longitudinal sectional view of a hermetic terminal applicable to the compressor of FIG. 1, in accordance with an alternative embodiment of the present invention, wherein the reference numerals are each 100 greater than those used to describe the embodiment of FIGS. 2 and 3.
Figure 5:
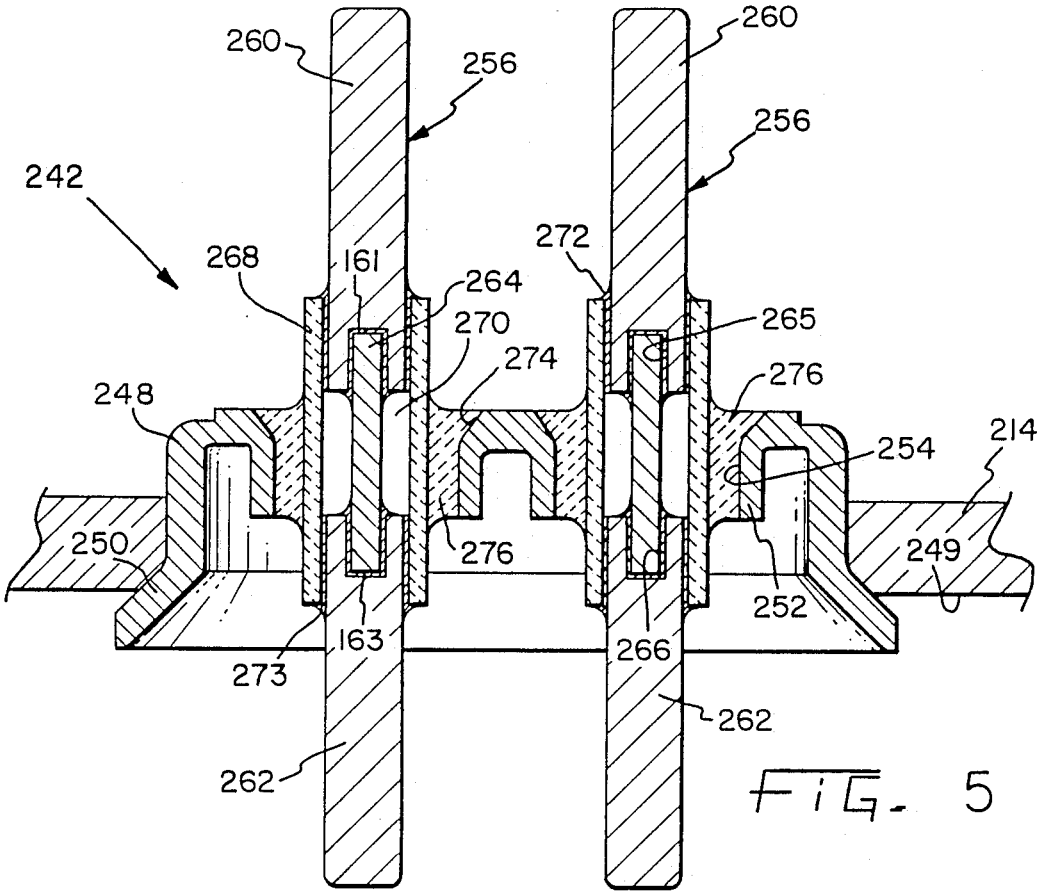
FIG. 5 is an enlarged longitudinal sectional view of another hermetic terminal applicable to the compressor of FIG. 1, in accordance with a further embodiment of the present invention, wherein the reference numerals are each 200 greater than those used to describe the embodiment of FIGS. 2 and 3.

FIGS. 4 and 5 show hermetic terminals applicable to the compressor of FIG. 1 in accordance with alternative embodiments of the present invention, wherein the aforementioned description of the embodiment of FIGS. 2 and 3 is equally applicable with the following exceptions. In FIG. 4, seal 176 contacts sleeve 168 and surrounds the junction between pin segment 160 and sleeve 168, while the junction between pin segment 162 and sleeve 168 remains exposed on the interior of the compressor housing. In FIG. 5, the axial dimension of sleeve 268 is increased, whereby the respective junctions between sleeve 268 and pin segments 260 and 262 are not surrounded by seal 276. Instead, seal 276 contacts only sleeve 268. Also, the axial extent to which pin segments 260 and 262 are telescopingly received within sleeve 268 is greater than that of the other embodiments, thereby providing more contacting and bonding surface area for joints 272 and 273.

In the manufacture of hermetic terminals of the type disclosed herein, it is recognized that it is desirable to maintain "flat" glass-to-metal seals between conductor pins and their respective collar portions of the terminal body, i.e., the integrity of the seal is enhanced with the compression glass-to-metal seal constraint provided by this arrangement. However, it is also necessary to maintain a minimum metal-to-metal oversurface distance between the conductor pins and the collar portions of the metallic terminal body. Typically, in order to achieve the required oversurface distances, the glass-to-metal seal has been made to climb the conductor pin axially away from the collar portions. Under certain circumstances, this puts the unconstrained portion of the glass seal in tension, resulting in cracking or the like.

According to the present invention, with particular reference to the embodiment of FIG. 5, insulating sleeve 268 is interposed in the radial space between pin segments 260 and 262 and collar 252, while the diameter of the pin segments and the radial thickness of glass seal 276 are maintained substantially at standard dimensions. Accordingly, the diameter of collars 252 is increased to accommodate the insulating sleeve 268 of the present invention. Consequently, as illustrated in FIG. 5, greater oversurface and through-seal insulating distances are achieved using a "flatter" glass-to-metal seal, which seal exhibits compression glass-to-metal seal constraint along the entire axial length thereof.

In a preferred embodiment of the invention, the inside diameter of collar 254 is approximately 0.300 inch and the outside diameter of sleeve 268 is approximately 0.200 inch, thereby resulting in a uniform radial thickness for glass seal 276 of approximately 0.050 inch. The inside diameter of sleeve 268, according to this particular embodiment, is approximately 0.135 inch.

As previously discussed with reference to the embodiment of FIG. 2, but equally applicable to all the embodiments, the connection between fusible link 64 and pin segments 60 and 62 may be made by brazing. Inasmuch as pin assembly 56 is assembled by first brazing the fusible link and pin segments together, and then sliding insulating sleeve 68 into position and making the brazed or glass-to-metal seal joints 72 and 73, it is recommended that a eutectic braze alloy be used to braze the fusible link and pin segments in order to avoid reflow when subsequently making joints 72 and 73.

It will be appreciated that the foregoing is presented by way of illustration only, and not by way of any limitation, and that various alternatives and modifications may be made to the illustrated embodiment without departing from the spirit and scope of the invention.

What is claimed is:

1. In a hermetic motor compressor unit having a housing with an opening therein and an electric motor operatively disposed within the housing, a hermetic terminal adapted for carrying electric current from the exterior of housing to the interior thereof, comprising:

a metallic body member closing the housing opening and having a plurality of collar portions defining pin openings in said body member communicating from the exterior of the housing to the interior thereof; and a plurality of current conducting pin assemblies respectively disposed in said pin openings and passing through said body member, each said pin assembly comprising an inner electrically conductive pin segment disposed at least partially inside the housing, an outer electrically conductive pin segment disposed at least partially outside the housing, an electrically insulating intermediate pin segment disposed at least partially within said collar portion and interconnecting said inner pin segment and said outer pin segment, said intermediate pin segment defining a closed cavity with said inner pin segment and said outer pin segment, and electrically conductive fusible means disposed within said closed cavity for fusibly electrically interconnecting said inner pin segment and said outer pin segment.

2. The hermetic motor compressor unit of claim 1 wherein said intermediate pin segment is a sleeve member having opposite open ends in which respective portions of said inner pin segment and said outer pin segment are telescopingly received and sealingly retained.

3. The hermetic motor compressor unit of claim 2 wherein said respective portions of said inner pin segment and said outer pin segment are sealingly retained within said open ends of said sleeve member by respective glass-to-metal seals.

4. The hermetic motor compressor unit of claim 2 wherein said sleeve member is composed of an electrically insulating ceramic material.

5. The hermetic motor compressor unit of claim 1 wherein each of said inner and outer pin segments is connected to said fusible means at a respective brazed joint therebetween.

6. The hermetic motor compressor unit of claim 5 wherein each of said respective brazed joints between said inner and outer pin segments and said fusible means includes a brazing filler metal of a silver-based alloy.

7. The hermetic motor compressor unit of claim 1 wherein said fusible means comprises an elongate fusible link having opposite ends, said opposite ends being disposed in respective counterbores in said inner and outer pin segments.

8. The hermetic motor compressor unit of claim 7 wherein said fusible link comprises a solid phosphor bronze cylinder having a diameter of approximately 0.040 inch and a melting temperature within an approximate range of 1750 to 1970 degrees Fahrenheit.

9. The hermetic motor compressor unit of claim 1, and further comprising:

an electrically insulating seal means, disposed intermediate and interconnecting each of said pin assemblies and a corresponding said collar portion, for sealingly closing each of said pin openings in said body member.

10. The hermetic motor compressor unit of claim 9 wherein said inner pin segment and said intermediate pin segment of each said pin assembly are connected at a joint therebetween, and said insulating seal means contacts only said inner pin segment and said intermediate pin segment of each said pin assembly in a manner surrounding said joint therebetween.

11. The hermetic motor compressor unit of claim 9 wherein said insulating seal means contacts only said intermediate pin segment of each said pin assembly.

12. The hermetic motor compressor unit of claim 9 wherein said outer pin segment and said intermediate pin segment of each said pin assembly are connected at a joint therebetween, and said insulating seal means contacts only said outer pin segment and said intermediate pin segment of each said pin assembly in a manner surrounding said joint therebetween.

13. The hermetic motor compressor unit of claim 9 wherein the diameter of each of said pin openings is greater than the diameter of a corresponding said intermediate pin segment disposed therein, said insulating seal means filling the radial distance between each of said intermediate pin segments and a corresponding said collar portion of said body member.

14. The hermetic motor compressor unit of claim 13 wherein the diameter of each said pin opening is approximately 0.300 inch and the diameter of each said intermediate pin segment is approximately 0.200 inch, said insulating seal means comprising an annular glass seal between said collar portion and said intermediate pin segment having a substantially uniform radial dimension of approximately 0.050 inch.

15. A hermetic terminal for interrupting the electrical current supplied to a hermetic compressor in the event of an overcurrent condition, comprising:

a body member; and a current conducting pin assembly passing through said body member, said pin assembly comprising a first electrically conductive pin segment, a second electrically conductive pin segment, an electrically insulating sleeve member interconnecting said first pin segment and said second pin segment, said sleeve member defining a closed cavity with said first pin segment and said second pin segment, and an electrically conductive fusible link electrically interconnecting said first pin segment and said second pin segment, said fusible link having opposite ends and being disposed within said closed cavity, said first pin segment being connected to one of said opposite ends of said fusible link at a first brazed joint, and said second pin segment being connected to the other of said opposite ends of said fusible link at a second brazed joint.

16. The hermetic terminal of claim 15 in which said sleeve member has opposite open ends in which respective end portions of said first pin segment and said second pin segment are telescopingly received and sealingly retained.

17. The hermetic terminal of claim 15 wherein said fusible link is a solid phosphor bronze cylinder having a diameter of approximately 0.040 inch and a melting temperature within an approximate range of 1750 to 1970 degrees Fahrenheit.

18. In a hermetic motor compressor unit having a housing with an opening therein and an electric motor operatively disposed within the housing, a hermetic terminal adapted for carrying electric current from the exterior of the housing to the interior thereof, comprising:

a metallic body member closing the housing opening and having a plurality of collar portions defining pin openings in said body member communicating from the exterior of the housing to the interior thereof;

a plurality of current conducting pin assemblies respectively disposed in said pin openings passing through said body member, each said pin assembly comprising an inner electrically conductive pin segment disposed at least partially inside the housing, an outer electrically conductive pin segment disposed at least partially outside the housing, a ceramic cylindrical sleeve at least partially disposed within said collar portion and interconnecting said inner pin segment and said outer pin segment, said inner and outer pin segments being telescopingly received within opposite ends of said intermediate pin segment, said sleeve defining a closed cavity with said inner pin segment and said outer pin segment, and an electrically conductive fusible link within said closed cavity having opposite ends for fusibly electrically interconnecting said inner pin segment and said outer pin segment, said opposite ends of said fusible link being disposed within respective counterbored portions of said inner pin segments and outer pin segments and being connected thereto by respective brazed joints; and an electrically insulating seal means, disposed intermediate and interconnecting each of said pin assemblies and a corresponding said collar portion, for sealingly closing each of said openings in said body member.

19. The hermetic motor compressor unit of claim 18 wherein the diameter of each of said pin openings is greater than the diameter of a corresponding said intermediate pin segment disposed therein, said insulating seal means filling the radial distance between each of said intermediate pin segments and a corresponding said collar portion of said body member.

20. The hermetic motor compressor unit of claim 19 wherein the diameter of each said pin opening is approximately 0.300 inch and the diameter of each said intermediate pin segment is approximately 0.200 inch, said insulating seal means comprising an annular glass seal between said collar portion and said intermediate pin segment having a substantially uniform radial dimension of approximately 0.050 inch.

* * * * *